US011587440B2

(12) United States Patent
Anthonny Paulino et al.

(10) Patent No.: US 11,587,440 B2
(45) Date of Patent: Feb. 21, 2023

(54) PREDICTION METHOD FOR RESILIENT INTERCONNECTED TRAFFIC MANAGEMENT

(71) Applicant: Kyndryl, Inc., New York, NY (US)

(72) Inventors: Michael Anthonny Paulino, Sao Paulo (BR); Renata Balthazar de Lima Mussauer, Rio de Janeiro (BR); Priscila Vieira de Sousa, Campinas (BR); Marcos Vinicius L. Paraiso, Campinas (BR); Thiago Rodrigues de Souza Costa, Belem (BR)

(73) Assignee: Kyndryl, Inc., New York, NY (US)

( * ) Notice: Subject to any disclaimer, the term of this patent is extended or adjusted under 35 U.S.C. 154(b) by 122 days.

(21) Appl. No.: 17/209,294

(22) Filed: Mar. 23, 2021

(65) Prior Publication Data

US 2022/0309917 A1 Sep. 29, 2022

(51) Int. Cl.
*G08G 1/095* (2006.01)
*H05B 47/17* (2020.01)
(Continued)

(52) U.S. Cl.
CPC ..... *G08G 1/095* (2013.01); *G08G 1/07* (2013.01); *G08G 1/097* (2013.01); *H05B 47/17* (2020.01)

(58) Field of Classification Search
CPC ..... G08G 1/095; G08G 1/07; G08G 1/097; H05B 47/17
See application file for complete search history.

(56) References Cited

U.S. PATENT DOCUMENTS 6,329,907 B1 12/2001 Uischner
9,076,332 B2 7/2015 Myr
(Continued)

FOREIGN PATENT DOCUMENTS

BR 102016013352 A2 12/2017
CA 3016825 A1 3/2019
(Continued)

OTHER PUBLICATIONS

"Data Clustering Algorithms", downloaded from the Internet on Nov. 2, 2020, 3 pages, <https://sites.google.com/site/dataclusteringalgorithms/home>.
(Continued)

*Primary Examiner* — Mohamed Barakat
(74) *Attorney, Agent, or Firm* — Erik Swanson, Esq.; Kevin P. Radigan, Esq.; Heslin Rothenberg Farley & Mesiti P.C.

(57) ABSTRACT

While it is well known to power traffic control devices (for example, traffic lights) by an alternative energy source during power outages, some embodiments of the present invention additionally have: (i) a set of control computer(s), remote from the various traffic control devices, that is powered by an alternative energy source during a power outage; and/or (ii) a communication network, for communications between the set of control computer(s) and the various traffic control devices, that is powered by an alternative power source during a power outage. The use of alternative power to power the control computer(s) (for example, a hub) and/or the communication network allows the traffic control devices to continue to operate in a coordinated manner as instructed by the control computers, thereby avoiding a situation where the traffic lights begin operating independently of each other during a power outage.

13 Claims, 5 Drawing Sheets

(51) Int. Cl.
*G08G 1/097* (2006.01)
*G08G 1/07* (2006.01)

(56) References Cited

U.S. PATENT DOCUMENTS

| | | | | |
|---|---|---|---|---|
| 10,152,881 | B2 | 12/2018 | Mubarek | |
| 10,172,409 | B1 * | 1/2019 | Andon | A43B 3/34 |
| 10,593,198 | B2 * | 3/2020 | Benhammou | H04L 9/30 |
| 11,438,989 | B1 * | 9/2022 | Recker | H05B 47/14 |
| 2012/0161982 | A1 * | 6/2012 | Musachio | E01F 9/30 340/932 |
| 2013/0285558 | A1 | 10/2013 | Recker | |
| 2016/0021013 | A1 * | 1/2016 | Vasseur | H04L 41/0677 370/235 |
| 2016/0284215 | A1 | 9/2016 | Ova | |
| 2017/0352264 | A1 * | 12/2017 | Thalanany | G08G 1/08 |
| 2018/0248400 | A1 * | 8/2018 | Emmorey | G08G 1/095 |
| 2019/0221114 | A1 * | 7/2019 | Hung | H05B 45/37 |

FOREIGN PATENT DOCUMENTS

| | | | |
|---|---|---|---|
| CN | 102063796 | B | 6/2013 |
| CN | 103931172 | A | 7/2014 |
| CN | 106530762 | A | 3/2017 |
| CN | 107230364 | A | 10/2017 |
| WO | 2014104869 | A1 | 7/2014 |

OTHER PUBLICATIONS

"Traffic Signal Battery Backup System", Oksolar, downloaded from the internet on Jan. 21, 2021, <https://www.oksolar.com/lion/Item/182812/traffic-signal-battery-backup-system, 13 pages.

"XGBoost Documentation", downloaded from the Internet on Nov. 2, 2020, 4 pages, <https://xgboost.readthedocs.io/en/latest/>.

* cited by examiner

PREDICTION METHOD FOR RESILIENT INTERCONNECTED TRAFFIC MANAGEMENT

BACKGROUND

The present invention relates generally to the field of traffic control systems that include traffic control devices (for example, traffic lights) and a set of traffic control computer(s) located remotely from the various traffic control devices out in the field (for example, located at traffic control headquarters). The set of traffic control computer(s) communicates with the various traffic control devices over a wide area network, such as the internet. At least some of the examples discussed herein will have only a single traffic control computer for the sake of simplicity of reader understanding. Some traffic control systems will have additional components, such as IoT (Internet of Things) type sensors, toll gate readers and the like.

The Wikipedia entry for "traffic light control and coordination" (as of 2 Feb. 2021) states as follows: "The normal function of traffic lights requires more than slight control and coordination to ensure that traffic and pedestrians move as smoothly, and safely as possible. A variety of different control systems are used to accomplish this, ranging from simple clockwork mechanisms to sophisticated computerized control and coordination systems that self-adjust to minimize delay to people using the junction . . . . A traffic signal is typically controlled by a controller mounted inside a cabinet . . . . [M]odern traffic controllers are solid state. The cabinet typically contains a power panel, to distribute electrical power in the cabinet; a detector interface panel, to connect to loop detectors and other detectors; detector amplifiers; the controller itself; a conflict monitor unit; flash transfer relays; a police panel, to allow the police to disable the signal; and other components . . . . Battery backup[.] In the areas that are prone to power interruptions, adding battery backups to the traffic controller systems can enhance the safety of the motorists and pedestrians. In the past, a larger capacity of uninterruptible power supply would be required to continue the full operations of the traffic signals using incandescent lights. The cost for such system would be prohibitive. After the newer generations of traffic signals that use LED lights which consume 85-90% less energy, it is now possible to incorporate battery backups into the traffic light systems. The battery backups would be installed in the traffic controller cabinet or in their own cabinet adjacent to the controller. The battery backups can operate the controller in emergency mode with the red light flashing or in fully functional mode . . . . Attempts are often made to place traffic signals on a coordinated system so that drivers encounter a green wave, a long string of green lights (the technical term is progression). The distinction between coordinated signals and synchronized signals is very important. Synchronized signals all change at the same time and are only used in special instances or in older systems. Coordinated (progressed) systems are controlled from a master controller and are set up so lights 'cascade' (progress) in sequence so platoons of vehicles can proceed through a continuous series of green lights . . . . More recently even more sophisticated methods have been employed. Traffic lights are sometimes centrally controlled by monitors or by computers to allow them to be coordinated in real time to deal with changing traffic patterns. Video cameras, or sensors buried in the pavement can be used to monitor traffic patterns across a city . . . . Traffic light systems are designed using software such as LINSIG, TRANSYT or VISSIM." (footnote(s) omitted)

SUMMARY

According to an aspect of the present invention, there is a method, computer program product and/or system for use with a traffic control system including a plurality of traffic control devices and a set of control computer(s) that performs the following operations (not necessarily in the following order): (i) operating the traffic control system from a primary power source, so that the plurality of traffic control devices are powered by the primary power source, the set of control computer(s) are powered by the primary power source and the traffic control devices are controlled, over a communication network, and by the set of control computer(s), in a coordinated manner such that the status for a given traffic control device depends, at least in part, upon a status of other traffic control devices at the same time or earlier; (ii) determining that a power outage is occurring or is likely to occur; (iii) responsive to the determination that a power outage is occurring or is likely to occur, switching the set of control computer(s) from being powered by the primary power source to being powered by an alternative power source; and (iv) subsequent to the switching of power source of the set of control computer(s), continuing operating the traffic control system so that the traffic control devices are controlled, over the communication network and by the set of control computer(s) in a coordinated manner such that the status for a given traffic control device depends, at least in part, upon a status of other traffic control devices at the same time or earlier.

According to an aspect of the present invention, there is a method, computer program product and/or system for use with a traffic control system including a plurality of traffic control devices and a set of control computer(s) that performs the following operations (not necessarily in the following order): (i) operating the traffic control system from a primary power source, so that the traffic control devices are controlled, over a primary communication network, and by the set of control computer(s), in a coordinated manner such that the status for a given traffic control device depends, at least in part, upon a status of other traffic control devices at the same time or earlier; (ii) determining that a communications outage in the primary communication network is occurring or is likely to occur; (iii) responsive to the determination that a communications outage is occurring or is likely to occur, switching communication between the set of control computer(s) and the plurality of traffic control devices from the primary communication network to an alternative communication network; and (iv) subsequent to the switching of communication network, continuing operating the traffic control system so that the traffic control devices are controlled, over the communication network and by the set of control computer(s) in a coordinated manner such that the status for a given traffic control device depends, at least in part, upon a status of other traffic control devices at the same time or earlier.

According to an aspect of the present invention, there is a method, computer program product and/or system for use with a traffic control system including a plurality of traffic control devices and a set of control computer(s) that performs the following operations (not necessarily in the following order): (i) operating the traffic control system from a primary power source, so that the plurality of traffic control devices are powered by the primary power source, the set of control computer(s) are powered by the primary power source and the traffic control devices are controlled, over a communication network, and by the set of control computer(s), in a coordinated manner such that the status for a given traffic control device depends, at least in part, upon a status of other traffic control devices at the same time or earlier; (ii) determining that a power outage is occurring or is likely to occur; (iii) responsive to the determination that a power outage is occurring or is likely to occur: (a) switching the set of control computer(s) from being powered by the primary power source to being powered by an alternative power source, and (b) switching the plurality of traffic control devices from being powered by the primary power source to being powered by an alternative power source; and (iv) subsequent to the switching of power source of the set of control computer(s) and the plurality of traffic control devices, continuing operating the traffic control system so that the traffic control devices are controlled, over the communication network and by the set of control computer(s) in a coordinated manner such that the status for a given traffic control device depends, at least in part, upon a status of other traffic control devices at the same time or earlier.

DETAILED DESCRIPTION

Figure 1:
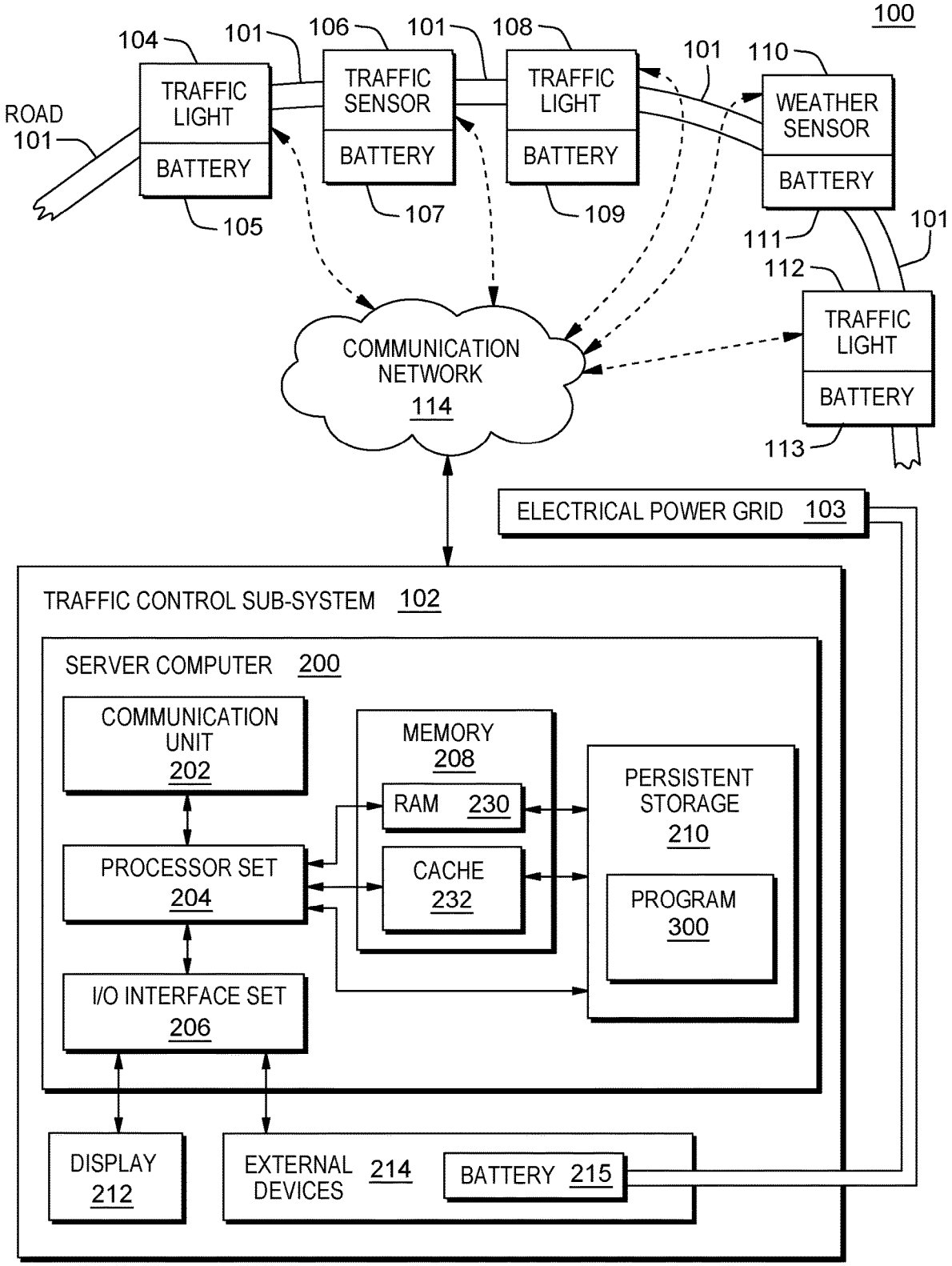
FIG. 1 is a block diagram view of a first embodiment of a system according to the present invention.

While it is well known to power traffic control devices (for example, traffic lights) by an alternative energy source during power outages, some embodiments of the present invention additionally have: (i) a set of control computer(s), remote from the various traffic control devices, that is powered by an alternative energy source during a power outage; and/or (ii) a communication network, for communications between the set of control computer(s) and the various traffic control devices, that is powered by an alternative power source during a power outage.

In currently conventional traffic management systems, there is a set of control computer(s), remote from the various traffic control devices of the system, in the form of a central hub. The central hub is typically managed by a city's traffic control team. From the location of the central hub, the city's traffic control team can monitor and manage how overall traffic is performing. When an outage scenario happens, not only can the energy outage affect each individual traffic light, but also communication to the central traffic management system. In this case, the traffic lights can lose synchronism, thus impacting the overall traffic flow. Some embodiments allow for autonomy and unsupervised decision making by the traffic lights, where they are able to communicate and coordinate the appropriate stop/go sequence to better manage traffic flow. With data capture by the method during its operation, the model can learn how to better optimize the sequence of traffic lights that must stay open/go/green in sync to better allow traffic to flow. Some embodiments consider possible scenarios where emergency units (ambulance, fire truck, police, etc.) need to get priorization, thus reorganizing the traffic light stop/go sequences to let the units reach their destination faster.

The battery, solar power array or any other secondary energy provider mechanism is a feature that provides the source of the alternative power mentioned above. The use of this kind of alternative power can help avoid complete shutdown of a traffic light system when a major outage happens (for example, connectivity issues to control hub, energy outage, etc.). Some embodiments not only keep the traffic control system keep operating, where energy power is a must, but also do so in an efficient way. When a traffic control system according to some embodiments of the present invention when there is a power outage, then the use of alternative power to power the control computer(s) (for example, a hub) and/or the communication network allows the traffic control devices to continue to operate in a coordinated manner as instructed by the control computers, thereby avoiding a situation where the traffic lights begin operating independently of each other during a power outage.

This Detailed Description section is divided into the following subsections: (i) The Hardware and Software Environment; (ii) Example Embodiment; (iii) Further Comments and/or Embodiments; and (iv) Definitions.

I. The Hardware and Software Environment

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (for example, light pulses passing through a fiber-optic cable), or electrical signals transmitted through a wire.

A "storage device" is hereby defined to be anything made or adapted to store computer code in a manner so that the computer code can be accessed by a computer processor. A storage device typically includes a storage medium, which is the material in, or on, which the data of the computer code is stored. A single "storage device" may have: (i) multiple discrete portions that are spaced apart, or distributed (for example, a set of six solid state storage devices respectively located in six laptop computers that collectively store a single computer program); and/or (ii) may use multiple storage media (for example, a set of computer code that is partially stored in as magnetic domains in a computer's non-volatile storage and partially stored in a set of semiconductor switches in the computer's volatile memory). The term "storage medium" should be construed to cover situations where multiple different types of storage media are used.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

As shown in FIG. 1, traffic control system 100 is an embodiment of a hardware and software environment for use with various embodiments of the present invention. Traffic control system 100 includes: road 101; traffic control sub-system 102 (sometimes herein referred to, more simply, as subsystem 102); electrical power grid 103; traffic lights 104, 108 and 112; batteries 105, 107, 109, 111, 113 and 215; traffic sensor 106; weather sensor 110; and communication network 114. Traffic control sub-system 102 includes: server computer 200; communication unit 202; processor set 204; input/output (I/O) interface set 206; memory 208; persistent storage 210; display 212; external device(s) 214; random access memory (RAM) 230; cache 232; and program 300.

Subsystem 102 may be a laptop computer, tablet computer, netbook computer, personal computer (PC), a desktop computer, a personal digital assistant (PDA), a smart phone, or any other type of computer (see definition of "computer" in Definitions section, below). Program 300 is a collection of machine readable instructions and/or data that is used to create, manage, and control certain software functions that will be discussed in detail, below, in the Example Embodiment subsection of this Detailed Description section.

Subsystem 102 is capable of communicating with other computer subsystems via communication network 114. Network 114 can be, for example, a local area network (LAN), a wide area network (WAN) such as the Internet, or a combination of the two, and can include wired, wireless, or fiber optic connections. In general, network 114 can be any combination of connections and protocols that will support communications between server and client subsystems.

Subsystem 102 is shown as a block diagram with many double arrows. These double arrows (no separate reference numerals) represent a communications fabric, which provides communications between various components of subsystem 102. This communications fabric can be implemented with any architecture designed for passing data and/or control information between processors (such as microprocessors, communications, and network processors, etc.), system memory, peripheral devices, and any other hardware components within a computer system. For example, the communications fabric can be implemented, at least in part, with one or more buses.

Memory 208 and persistent storage 210 are computer-readable storage media. In general, memory 208 can include any suitable volatile or non-volatile computer-readable storage media. It is further noted that, now and/or in the near future: (i) external device(s) 214 may be able to supply, some or all, memory for subsystem 102; and/or (ii) devices external to subsystem 102 may be able to provide memory for subsystem 102. Both memory 208 and persistent storage 210: (i) store data in a manner that is less transient than a signal in transit; and (ii) store data on a tangible medium (such as magnetic or optical domains). In this embodiment, memory 208 is volatile storage, while persistent storage 210 provides nonvolatile storage. The media used by persistent storage 210 may also be removable. For example, a removable hard drive may be used for persistent storage 210. Other examples include optical and magnetic disks, thumb drives, and smart cards that are inserted into a drive for transfer onto another computer-readable storage medium that is also part of persistent storage 210.

Communications unit 202 provides for communications with other data processing systems or devices external to subsystem 102. In these examples, communications unit 202 includes one or more network interface cards. Communications unit 202 may provide communications through the use of either or both physical and wireless communications links. Any software modules discussed herein may be downloaded to a persistent storage device (such as persistent storage 210) through a communications unit (such as communications unit 202).

I/O interface set 206 allows for input and output of data with other devices that may be connected locally in data communication with server computer 200. For example, I/O interface set 206 provides a connection to external device set 214. External device set 214 will typically include devices such as a keyboard, keypad, a touch screen, and/or some other suitable input device. External device set 214 can also include portable computer-readable storage media such as, for example, thumb drives, portable optical or magnetic disks, and memory cards. Software and data used to practice embodiments of the present invention, for example, program 300, can be stored on such portable computer-readable storage media. I/O interface set 206 also connects in data communication with display 212. Display 212 is a display device that provides a mechanism to display data to a user and may be, for example, a computer monitor or a smart phone display screen.

In this embodiment, program 300 is stored in persistent storage 210 for access and/or execution by one or more computer processors of processor set 204, usually through one or more memories of memory 208. It will be understood by those of skill in the art that program 300 may be stored in a more highly distributed manner during its run time and/or when it is not running. Program 300 may include both machine readable and performable instructions and/or substantive data (that is, the type of data stored in a database). In this particular embodiment, persistent storage 210 includes a magnetic hard disk drive. To name some possible variations, persistent storage 210 may include a solid state hard drive, a semiconductor storage device, read-only memory (ROM), erasable programmable read-only memory (EPROM), flash memory, or any other computer-readable storage media that is capable of storing program instructions or digital information.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

II. Example Embodiment

Figure 2:
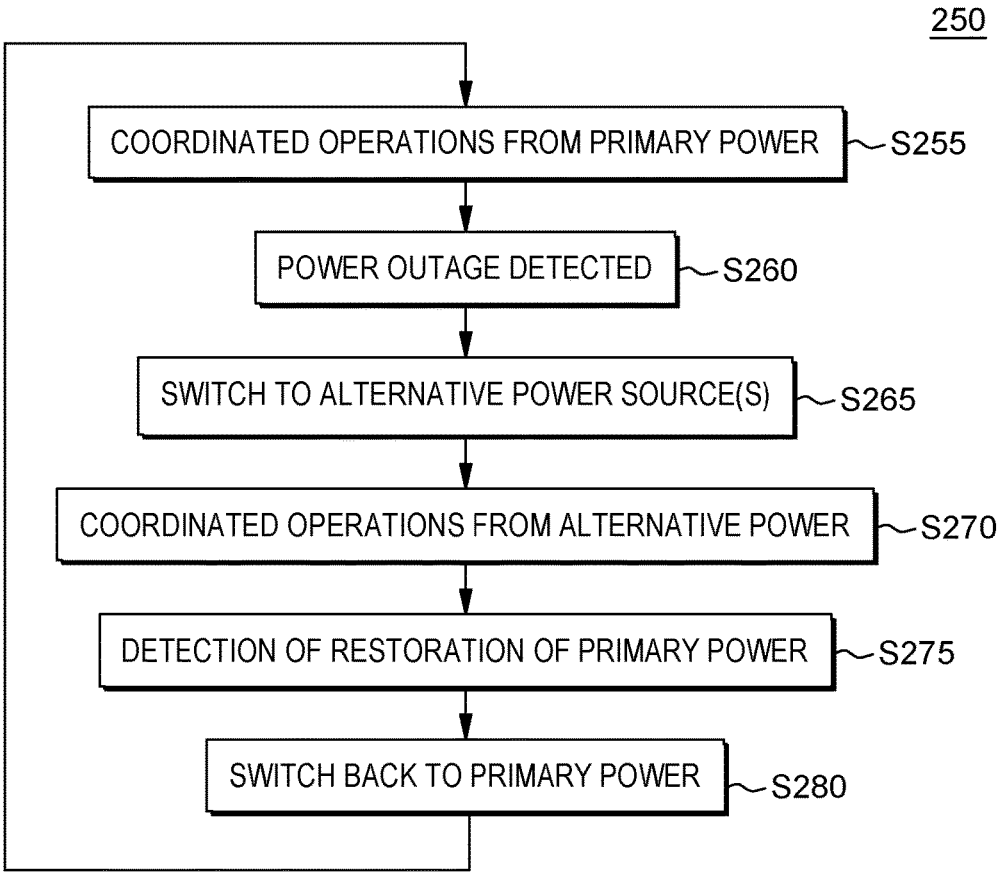
FIG. 2 is a flowchart showing a first embodiment method performed, at least in part, by the first embodiment system.
Figure 3:
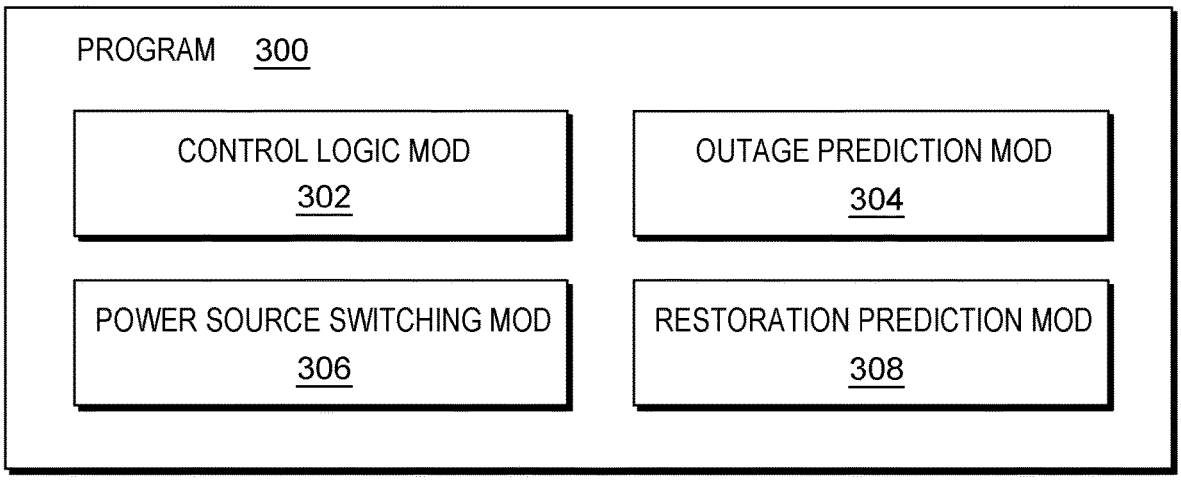
FIG. 3 is a block diagram showing a machine logic (for example, software) portion of the first embodiment system.

As shown in FIG. 1, traffic control system 100 is an environment in which an example method according to the present invention can be performed. As shown in FIG. 2, flowchart 250 shows an example method according to the present invention. As shown in FIG. 3, program 300 performs or controls performance of at least some of the method operations of flowchart 250. This method and associated software will now be discussed, over the course of the following paragraphs, with extensive reference to the blocks of FIGS. 1, 2 and 3.

Figure 4:
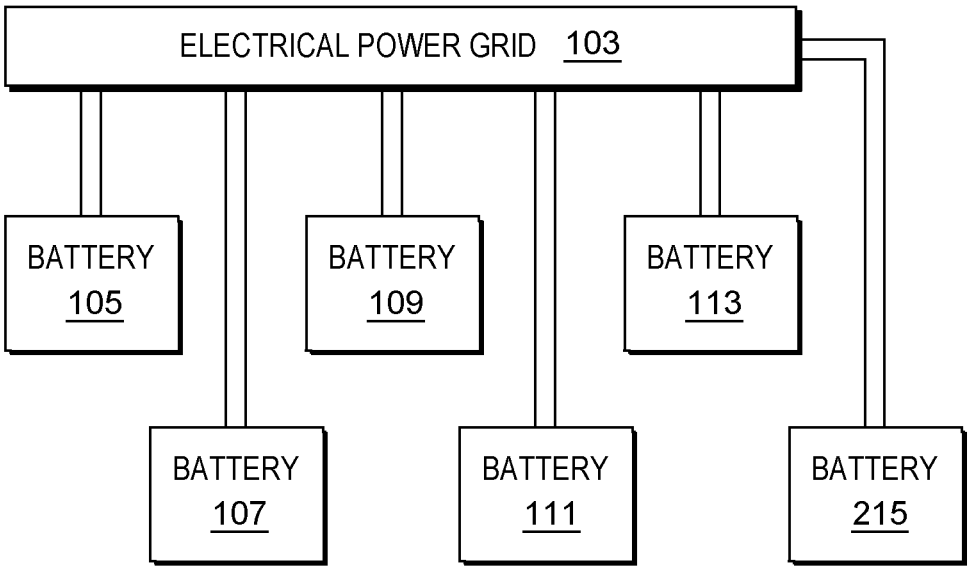
FIG. 4 is a screenshot view generated by the first embodiment system.

Processing begins at operation S255, where system control logic module 302 operates the traffic control devices (in this case traffic lights 104, 108 and 112) of traffic control system 100 from a primary power source. In this example, the primary power source is electrical power grid 103, which is the same grid that provides electric power to residences and businesses. In this example, traffic control sub-system 102, traffic sensor 106 and weather sensor 112 are also powered by electrical power grid 103. As shown in FIG. 4, and more specifically, during the normal operations of traffic control system 100, each device is powered through its respective battery (specifically, batteries 105, 107, 109, 111, 113 and 215). Alternatively, the primary power may flow directly to the various devices of traffic control system, without passing through any batteries, and, indeed, some embodiments of the present invention may not include batteries at all.

Mod 302 controls the traffic control devices in a coordinated manner such that the status for a given traffic control device depends, at least in part, upon a status of other traffic control devices at the same time or earlier. In this example, mod 302 accomplishes coordinated control by a set of machine logic rules including the following: (i) traffic light 104 is controlled to be green only when traffic light 112 was green x seconds earlier in time, where the current value of x depends upon traffic sensed by traffic sensor 106 in the past 15 minutes; (ii) traffic light 108 is controlled to be green only when traffic light 104 was green y seconds earlier in time, where the current value of y depends upon weather conditions sensed by weather sensor 110 in the past 60 minutes; and (iii) traffic light 112 is controlled to be green only when traffic light 112 was green x seconds earlier in time (rule for weekdays) or y seconds earlier in time (rule for weekends).

Processing proceeds to operation S260, where outage prediction mod 304 determines that a power outage is occurring or is likely to occur.

Processing proceeds to operation S265, where, responsive to the determination that a power outage is occurring or is likely to occur at operation S260, power source switching mod 306 switches the set of control computer(s) (in this example, traffic control subsystem 102), set of traffic control device(s) (in this example, traffic lights 104, 108 and 112) and set of sensor(s) (in this example, sensors 106 and 110) from being powered by the primary power source to being powered by an alternative power source. More specifically, in this example: (i) the primary power source is electrical power grid 103, which has gone out in this example due to an unusually sever ice storm; and (ii) the alternative power is the various local batteries of the system 105, 107, 109, 111, 113 and 215. To try to explain it more clearly, instead of passing utility power to the various respective devices, the batteries instead are switched in their configurations so that they supply power instead from the power stored in the battery as electrochemical potential. Preferably, the batteries should be designed with sufficient capacity so that operations can utilize battery power for the duration of the power outage.

As may be explained in the next subsection of this Detailed Description section, other types of alternative power sources, now known or to be developed in the future are possible. Also, not every device in the system needs to have the same alternative power source. For example, the traffic lights could be powered by wind power from windmills built into each traffic light, while the control computer might draw its alternative power, during outages, from a hydroelectric source located next door to the headquarters of the traffic control division of the local municipal government.

Processing proceeds to operation S270, where, subsequent to the switching of operation S265, continuing operating the traffic control system so that the traffic control devices are controlled, over the communication network and by the set of control computer(s) in a coordinated manner such that the status for a given traffic control device depends, at least in part, upon a status of other traffic control devices at the same time or earlier.

Processing proceeds to operation S275, where restoration prediction mod 308 determines (by direct information or by prediction based on real time circumstances and context) that the power outage is over.

Processing proceeds to operation S280, where, responsive to the determination that the power outage is over, switching the set of control computer(s) from being powered by the alternative power source to being powered by the primary power source.

As shown by the dashed lines in FIG. 1, in the foregoing example of flowchart 250, the data communication connections between traffic control devices and/or sensors and the communication network include wireless links.

III. Further Comments and/or Embodiments

A method according to an embodiment of the present invention for resilient interconnected traffic management includes at least some of the following operations (not necessarily in the following order): (i) detecting an outage associated with a network including multiple nodes in the form of networked computers; (ii) enabling a resilient control module using an alternative energy source; (iii) controlling decisions as a stand-alone grid by the resilient control module and over a communication channel, such that the nodes of the network continue to remain active using alternative energy sources; (iv) performing, by the resilient control module, a broadcast to the multiple nodes of the network; (v) receiving, from responding nodes of the multiple nodes of the network and by the resilient control module, affirmative responses; (vi) generating a predictive grid including only the responding nodes; (vii) receiving, by the resilient control module and from the responding nodes, unstructured data; (viii) grouping the unstructured data using a data clustering algorithm to form multiple data clusters; (ix) determining a first similar object for a first data cluster from the multiple clusters; and (x) defining training data based, at least in part, on the first similar object of the first data cluster.

The method of the preceding paragraph may further include one, or more, of the following operations: (i) training a model using the training data to learn traffic behavior during the outage; (ii) applying a machine learning algorithm to provide parallel tree boosting; (iii) training a decision model to react according to the traffic behavior during the outage; (iv) generating a result to predict and prioritize traffic; (v) updating the result, in response to a change in external signs, including new instructions and retraining the model to adapt to the new external signs; (vi) broadcasting, to each node of the grid, contingency instructions specifying a reaction to the outage while monitoring the outage; (vii) in response to received status information from the nodes, determining whether a resilient mode is required; and (viii) in response to a determination the resilient mode is not required: (a) sending a new broadcast, (b) disabling the contingency instructions, and (c) reactivating traffic light grid standard procedures.

Some embodiments of the present invention may include one, or more, of the following operations, features, characteristics and/or advantages: (i) determines a better route at traffic intersections; (ii) provides resiliency options to avoid unexpected outages for traffic light systems; (iii) learns traffic behavior for each scenario; (iv) determines average delays per vehicle for each movement at their respective intersections; (v) compensates for power outages; (vi) detects an outage and enables a resilient module using alternative energy and communication channel (that is, solar panel, solar battery, mesh communication) so it can control the decisions as stand-alone grid; (vii) the nodes of the network will continue to be active using alternative energy sources (such as solar energy panels, onboard batteries) and communication flow (that is, a radio frequency mesh network); and/or (viii) considers resiliency methods to mitigate unexpected unavailability of the system.

Some embodiments of the present invention may include one, or more, of the following operations, features, characteristics and/or advantages: (i) applies a machine learning algorithm to provide parallel tree boosting; (ii) trains a decision model to determine how the system needs to react based on the outage behavior; (iii) the system results predicts and prioritizes traffic management (for example, which traffic light needs to be on and can be off without major impact and how long an intersection needs to flow to avoid a traffic jam inside a tunnel); (iv) provides options to train and improve system results; (v) provides better decisions for traffic at intersections; (vi) detects an outage and enables a resilient module using alternative energy; (vii) creates a predictive system to enhance better results for traffic flow; (viii) considers unexpected unavailability of the system; (ix) focuses in detecting patterns during user activity to suggest key mappings for multiple computing devices using a single input service; (x) utilizes default keys in specific desktops (for example: "Windows Key"); and/or (xi) default keys could be mapped to call an application or change the desktop.

Some embodiments of the present invention may include one, or more, of the following operations, features, characteristics and/or advantages: (i) analyzes images from the cameras; (ii) provides insights for the traffic lights by looking for better road options to reduce or avoid congestion; (iii) applies a method in case of power and/or communication outage; (iv) uses cameras to: (a) analyze image data, and/or (b) provide artificial intelligence insights and options to reduce or avoid congestion; (v) is based on camera and image analysis to provide decisions due to predictive insights; (vi) uses cameras on traffic lights only; (vii) data is stored together with others sources from police, fire departments, civil defense, and/or other organizations; and/or (viii) uses cameras and image analysis to provide real-time routes to avoid congestion in the roads.

Some embodiments of the present invention recognize the following facts, potential problems and/or potential areas for improvement with respect to the current state of the art: (i) in a smart cities world, decisions on how to coordinate the city operations are automatically taken by the equipment that support the city (for example, a camera that triggers an alert after identifying someone by facial recognition, meaning the equipment was trained to react that way); (ii) when unforeseen conditions impact functionality, such as energy powering interruption or communication failure, how the system continues to follow standard instructions may not be known; (iii) has concerns about the safety of citizens and users; (iv) when systems doesn't know how to behave, how to preserve the users integrity may be unknown; (v) as the traffic lights lose their standard guidelines, the lack of synchronization and communication present risks to vehicles and pedestrians; (vi) at an intersection, a car may not have clear instructions if it should move forward or stop; (vii) if a pedestrian needs to cross a major avenue, he/she may not have the chance to cross because the traffic lights lost their standard instructions; (viii) to mitigate the risks, and solve problems, the traffic management during a power or communication outage situation needs a to resilient in a way to react to the uncertainty; (ix) traffic management needs a way to learn from unstructured scenarios and offer intelligence to react on the communication and traffic management, preserving the safety of the users that may be impacted; and/or (x) in a large city, traffic lights on a main intersection lose connection and lose the ability to manage the traffic, this puts pedestrians and vehicles at risk as the system doesn't have instructions to follow.

Some embodiments of the present invention may include one, or more, of the following operations, features, characteristics and/or advantages: (i) discloses an appliance method for resilient interconnected traffic lights; (ii) uses a module to detect outage; (iii) given an outage, the system enables a resilient module (that is, solar panel, solar battery, mesh communication) to control the decisions as a stand-alone grid; (iv) a device system starts broadcasting (pinging) to other devices to identify devices that are yet active, (for example, mesh networking); (v) the nodes of the network will continue to be active by using alternative energy sources, such as solar energy panels, onboard batteries, as well as communication flow (for example, a radio frequency mesh network); (vi) a cycle propagates to the border of the network to map the offline extension; and/or (vii) once the system maps the outage border, the system starts analyzing external signs to predict how to react to the outage.

Some embodiments of the present invention may include one, or more, of the following operations, features, characteristics and/or advantages: (i) based on external signs used to measure traffic volume, such as monitoring cameras, traffic volume sensors, speed control sensors, emergency notifications from smart city centers—police, fire dept, the system feeds a model that learns how traffic behaves in such a scenario; (ii) a second training level requires the system to learn how to react based on the outage behavior; (iii) the system broadcasts, to each node of the grid, instructions on how to react to the outage while monitoring the outage that is still happening; (iv) the system results predict and prioritize the traffic management (that is, which traffic lights needs to be on and can be off without major impact, as well as how long an intersection needs to flow to avoid traffic jam inside a tunnel); (v) the system may change the instructions and retrain the model adapting to new external signs; and/or (vi) once the outage ends, the system will start a new broadcast, disabling the contingency instructions and reactivating the traffic light grid standard procedures.

Some embodiments of the present invention may include one, or more, of the following operations, features, characteristics and/or advantages: (i) predicts and prioritizes traffic management; (ii) retrains the model to adapt to new conditions of outage; and/or (iii) monitors and restores system power autonomy.

Figure 5:
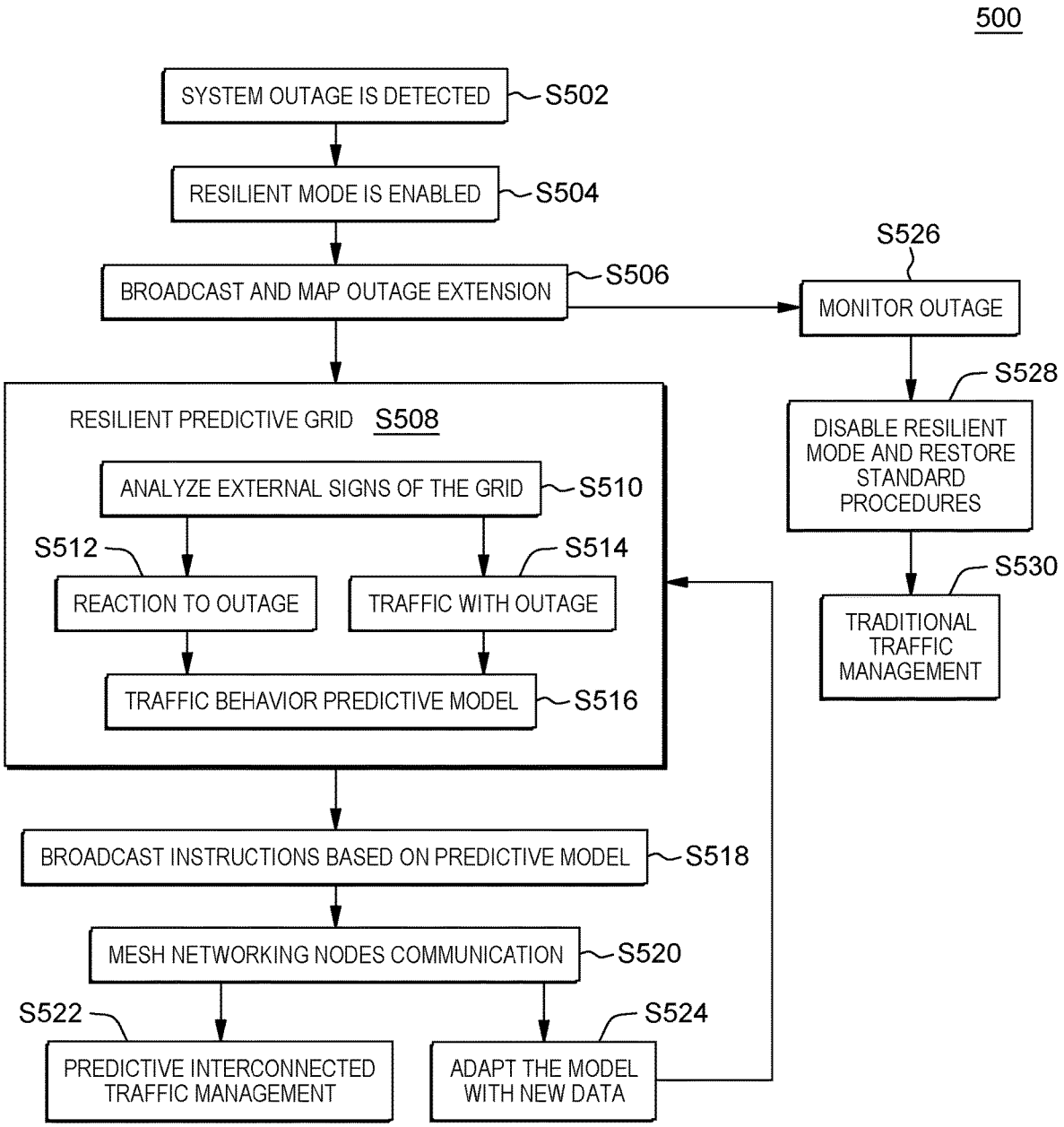
FIG. 5 is a flowchart showing a second embodiment method according to the present invention.

As shown in FIG. 5, flowchart 500 represents a method with the following operations (with process flow among, and between, the operations as shown by arrows in FIG. 5): system outage is detected block S502; resilient mode is enabled block S504; broadcast and map outage extension block S506; resilient predictive grid block S508; analyze external signs of the grid block S510; reaction to outage block S512; traffic with outage block S514; traffic behavior predictive model block S516; broadcast instructions based on predictive model block S518; mesh networking nodes communication block S520; predictive interconnected traffic management block S522; adapt the model with new data block S524; monitor outage block S526; disable resilient mode and restore standard procedures block S528; and traditional traffic management block S530.

Some embodiments of the present invention may include one, or more, of the following operations, features, characteristics and/or advantages: (i) leverages as improvement on smart cities solutions, by applying predictive analysis; (ii) detects an outage and enables a resilient module using alternative energy and communication channels (for example, solar panels, solar batteries, and/or mesh communications) so it can control the decisions as a stand-alone grid; and/or (iii) the nodes of the network will continue to be active by using alternative energy sources, such as solar energy panels, onboard batteries, and communication flow (that is, using a radio frequency mesh network).

Some embodiments of the present invention may include one, or more, of the following operations, features, characteristics and/or advantages with respect to broadcast and map outage extensions: (i) broadcasts a signal to each device on the grid; (ii) if the device has resilient power and communication, a signal (ping) is sent back to the source device; (iii) a network handshake is done when one device confirms the communication to the other node on the grid; (iv) the grid map shows the devices that are active with a flag (YES) or inactive (NO); and/or (v) the predictive grid is established only with the nodes flagged with YES.

Some embodiments of the present invention may include one, or more, of the following operations, features, characteristics and/or advantages with respect to resilient predictive grids: (i) devices with the ability to provide data (for example, using monitoring cameras, traffic volume sensors, and/or speed control sensor) feed the system with data produced by the grid; (ii) unstructured data is grouped using a data clustering algorithm; (iii) with the data clustered, similar objects of a group will define the data for the system training; (iv) the system feeds the model to learn how the traffic is behaving during a power or communication outage; (v) the system applies machine learning to provide parallel tree boosting and train a decision model to learn how the system needs to react based on the outage behavior; (vi) the system results predicts and prioritizes the traffic management (for example, which traffic light needs to be on and can be off without major impact, and how long an intersection needs to flow to avoid a traffic jam inside a tunnel); (vii) the system may change the instructions and retrain the model adapting to new external signs; (viii) the system broadcasts to each node of the grid instructions on how to react to the outage while monitoring the outage that is still happening; and/or (ix) broadcasts a signal to each device on the grid.

Some embodiments of the present invention may include one, or more, of the following operations, features, characteristics and/or advantages with respect to monitoring outages: (i) on the existing grid, broadcasts to all the nodes from time to time, and returns a flag of resilient power and communication status; (ii) based on the status, the system determines if the resilient mode is required or can be disabled; and/or (iii) once the outage ends, the system will start a new broadcast, disabling the contingency instructions, and reactivates the traffic light grid using standard procedures.

Figure 6:
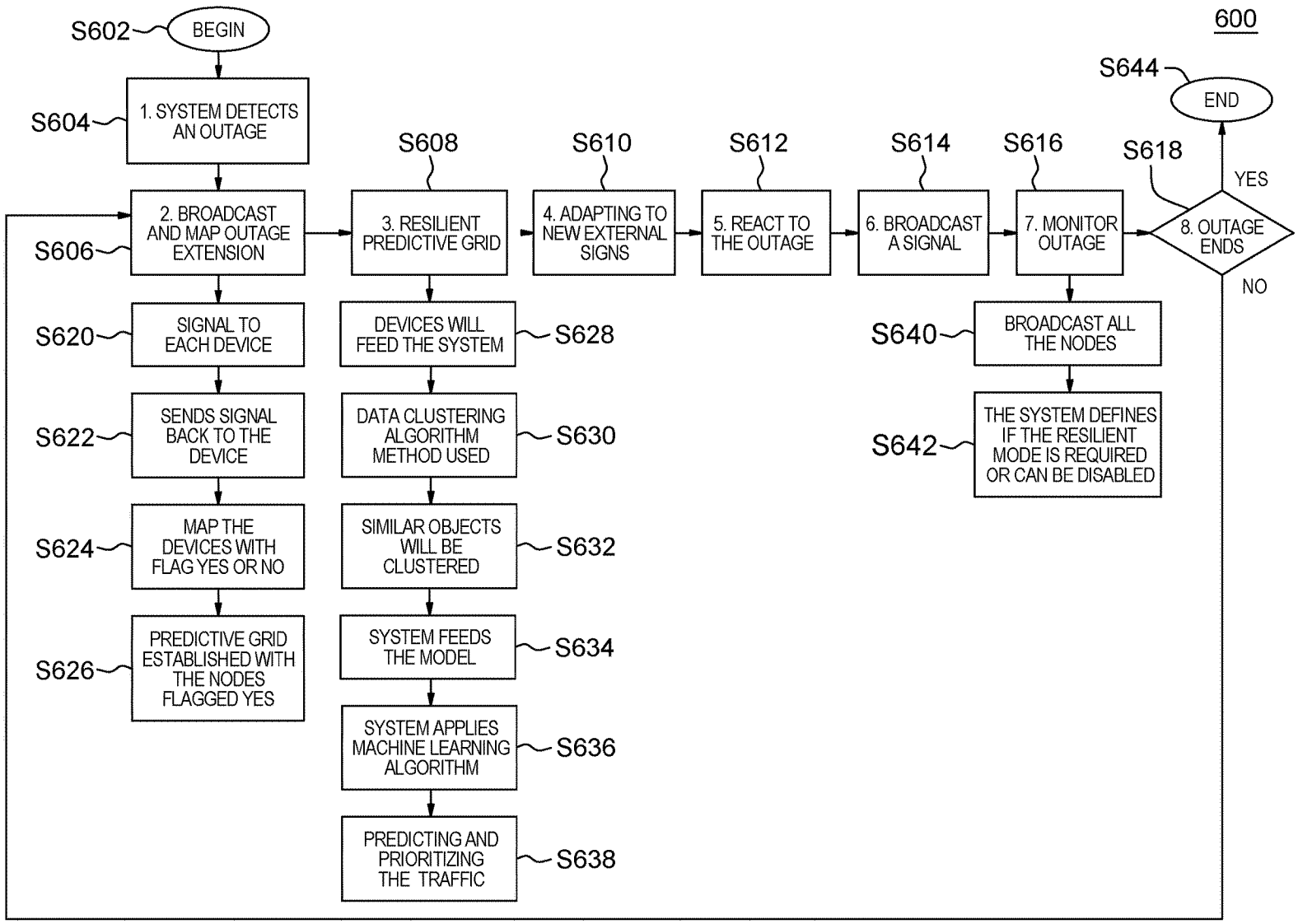
FIG. 6 is a flowchart showing a third embodiment method according to the present invention.

As shown in FIG. 6, flowchart 600 represents a method with the following operations (with process flow among, and between, the operations as shown by arrows in FIG. 6): begin block S602; system detects an outage block S604; broadcast and map outage extension block S606; resilient predictive grid block S608; adapting to new external signs block S610; react to the outage block S612; broadcast a signal block S614; monitor outage block S616; outage ends block S618; signal to each device block S620; sends signal back to the device block S622; map the devices with flag YES or NO block S624; predictive grid established with the nodes flagged YES block S626; devices will feed the system block S628; data clustering algorithm method used block S630; similar objects will be clustered block S632; system feeds the model block S634; system applies machine learning algorithm block S636; predicting and prioritizing the traffic block S638; broadcast all the nodes block S640; the system defines if the resilient mode is required or can be disabled block S642; end block S644.

Utilizing a use case example, some embodiments of the present invention may include one, or more, of the following operations, features, characteristics and/or advantages with respect to a city with more than 1,000,000 people and 200,000 vehicles that is being affected by a hurricane: (i) the city: (a) utilizes multiple methods of automatic energy generator (for example, wind), (b) receives data from police stations, civil defense authorities, weather stations, and or cameras, (c) analyzes the aforementioned data, (d) provides insights and predictions to reduce congestion, (e) minimizes the risk of accidents, and/or (f) the flow of traffic would be guaranteed and the quality of life for the people enhanced; (ii) the system detects a power outage and the resilient mode is activated, utilizing internal batteries to supply energy for the traffic lights; (iii) after a system validation to determine which devices are active, the grid is established only with the nodes that are live; (iv) utilizing data from devices such as monitoring cameras, traffic volume sensors, speed control sensors, etc., the system will utilize the model to learn how the traffic is behaving, taking into account power and/or communication outages, and will provide results predicting and prioritizing the traffic management for the vehicles; (v) results are shared for the devices on the grid using mesh network communication; (vi) the system could be retrained to learn new conditions of outage and have new predictive insights to manage traffic on the roads; and/or (vii) if the power outage is over, the resilient mode could be disabled and the traditional traffic management system could be activated again.

IV. Definitions

Present invention: should not be taken as an absolute indication that the subject matter described by the term "present invention" is covered by either the claims as they are filed, or by the claims that may eventually issue after patent prosecution; while the term "present invention" is used to help the reader to get a general feel for which disclosures herein are believed to potentially be new, this understanding, as indicated by use of the term "present invention," is tentative and provisional and subject to change over the course of patent prosecution as relevant information is developed and as the claims are potentially amended.

Embodiment: see definition of "present invention" above—similar cautions apply to the term "embodiment."

and/or: inclusive or; for example, A, B "and/or" C means that at least one of A or B or C is true and applicable.

Including/include/includes: unless otherwise explicitly noted, means "including but not necessarily limited to."

Module/Sub-Module: any set of hardware, firmware and/or software that operatively works to do some kind of function, without regard to whether the module is: (i) in a single local proximity; (ii) distributed over a wide area; (iii) in a single proximity within a larger piece of software code; (iv) located within a single piece of software code; (v) located in a single storage device, memory or medium; (vi) mechanically connected; (vii) electrically connected; and/or (viii) connected in data communication.

Computer: any device with significant data processing and/or machine readable instruction reading capabilities including, but not limited to: desktop computers, mainframe computers, laptop computers, field-programmable gate array (FPGA) based devices, smart phones, personal digital assistants (PDAs), body-mounted or inserted computers, embedded device style computers, application-specific integrated circuit (ASIC) based devices.

What is claimed is:

1. A computer-implemented method (CIM) for use with a traffic control system including a plurality of traffic control devices and a set of control computer(s), the CIM comprising:

operating the traffic control system from a primary power source, so that the plurality of traffic control devices are powered by the primary power source, the set of control computer(s) are powered by the primary power source and the traffic control devices are controlled, over a communication network, and by the set of control computer(s), in a coordinated manner such that a status for a given traffic control device depends, at least in part, upon a status of other traffic control devices at the same time or earlier;

determining that a power outage is occurring or may occur;

responsive to the determination that a power outage is occurring or is likely to occur, switching the set of control computer(s) from being powered by the primary power source to being powered by an alternative power source; and subsequent to the switching of power source of the set of control computer(s), continuing operating the traffic control system so that the traffic control devices are controlled, over the communication network and by the set of control computer(s) in a coordinated manner such that the status for a given traffic control device depends, at least in part, upon a status of other traffic control devices at the same time or earlier.

2. The CIM of claim 1 further comprising:

during the continuing operating of the traffic control system, determining that the power outage is over; and responsive to the determination that the power outage is over, switching the set of control computer(s) from being powered by the alternative power source to being powered by the primary power source.

3. The CIM of claim 1 wherein the alternative power source is battery power supplied by a set of battery(ies).

4. The CIM of claim 1 wherein the communication network includes wireless links to at least some of the traffic control devices of the plurality of traffic control devices.

5. The CIM of claim 1 wherein:

the traffic control system further includes condition and traffic sensors that communicate over the communication network with the set of control computer(s); and the condition and traffic sensors can be operated on power from the primary power source and also on power from the alternative power source.

6. The CIM of claim 1 wherein the primary power source is a utility electrical power grid that serve an area where the traffic control system is located.

7. A computer-implemented method (CIM) for use with a traffic control system including a plurality of traffic control devices and a set of control computer(s), the CIM comprising:

operating the traffic control system from a primary power source, so that the plurality of traffic control devices are powered by the primary power source, the set of control computer(s) are powered by the primary power source and the traffic control devices are controlled, over a communication network, and by the set of control computer(s), in a coordinated manner such that a status for a given traffic control device depends, at least in part, upon a status of other traffic control devices at the same time or earlier;

determining that a power outage is occurring or may occur;

responsive to the determination that a power outage is occurring or is likely to occur:

switching the set of control computer(s) from being powered by the primary power source to being powered by an alternative power source, and switching the plurality of traffic control devices from being powered by the primary power source to being powered by an alternative power source; and subsequent to the switching of power source of the set of control computer(s) and the plurality of traffic control devices, continuing operating the traffic control system so that the traffic control devices are controlled, over the communication network and by the set of control computer(s) in a coordinated manner such that the status for a given traffic control device depends, at least in part, upon a status of other traffic control devices at the same time or earlier.

8. The CIM of claim 7 further comprising:

during the continuing operating of the traffic control system, determining that the power outage is over; and responsive to the determination that the power outage is over:

switching the set of control computer(s) from being powered by the alternative power source to being powered by the primary power source, and switching the plurality of traffic control devices from being powered by the alternative power source to being powered by the primary power source.

9. The CIM of claim 7 wherein the alternative power source is battery power supplied by a set of battery(ies).

10. The CIM of claim 7 wherein the communication network includes wireless links to at least some of the traffic control devices of the plurality of traffic control devices.

11. The CIM of claim 7 wherein:

the traffic control system further includes condition and traffic sensors that communicate over the communication network with the set of control computer(s); and the condition and traffic sensors can be operated on power from the primary power source and also on power from the alternative power source.

12. The CIM of claim 7 wherein the primary power source is a utility electrical power grid that serve an area where the traffic control system is located.

13. The CIM of claim 7 wherein the plurality of traffic control devices include a plurality of traffic lights that are operated in a coordinated manner.

* * * * *